US006453895B2

(12) United States Patent
Takahashi et al.

(10) Patent No.: US 6,453,895 B2
(45) Date of Patent: Sep. 24, 2002

(54) FEEDBACK CONTROL DEVICE AND FEEDBACK CONTROL METHOD OF AIR-FUEL RATIO IN INTERNAL COMBUSTION ENGINE

(75) Inventors: Koji Takahashi; Shigeo Ohkuma, both of Atsugi (JP)

(73) Assignee: Unisia Jecs Corporation, Kanagawa (JP)

( * ) Notice: Subject to any disclaimer, the term of this patent is extended or adjusted under 35 U.S.C. 154(b) by 5 days.

(21) Appl. No.: 09/808,402

(22) Filed: Mar. 15, 2001

(30) Foreign Application Priority Data

Mar. 17, 2000 (JP) ..... 2000-075264
Mar. 17, 2000 (JP) ..... 2000-075838

(51) Int. Cl.[7] ..... F02D 41/14
(52) U.S. Cl. ..... 123/681; 123/698
(58) Field of Search ..... 123/681, 698; 701/109

(56) References Cited

U.S. PATENT DOCUMENTS 4,913,121 A * 4/1990 Shimomura et al. ..... 123/520
5,535,135 A * 7/1996 Bush et al. ..... 123/672
5,845,491 A * 12/1998 Yasui et al. ..... 123/674

FOREIGN PATENT DOCUMENTS

JP 8-232713 9/1996

* cited by examiner

*Primary Examiner*—Erick Solis
(74) *Attorney, Agent, or Firm*—McDermott, Will & Emery

(57) ABSTRACT

An air-fuel ratio feedback control of an internal combustion engine is performed, by a sliding mode control, by computing an air-fuel ratio feedback control amount including a linear term and a nonlinear term, and at the time of when switching a target air-fuel ratio or at the time of when switching the operating condition, such as the cutting of purge, where the air-fuel ratio is changed, the nonlinear term is initializing to a predetermined value corresponding to the post-switched operating condition.

20 Claims, 9 Drawing Sheets

C/U
11
12
13
14
15
16
17
18
19
20
21

| TARGET AIR-FUEL RATIO | NONLINEAR PORTION |
|---|---|
| 15.5 | -0.051613 |
| 15.3 | -0.039216 |
| 15.1 | -0.026490 |
| 14.9 | -0.013423 |
| 14.7 | 0 |
| 14.5 | 0.013793 |
| 14.3 | 0.027972 |
| 14.1 | 0.042553 |
| 13.9 | 0.057554 |
| 13.7 | 0.072993 |

FEEDBACK CONTROL DEVICE AND FEEDBACK CONTROL METHOD OF AIR-FUEL RATIO IN INTERNAL COMBUSTION ENGINE

FIELD OF THE INVENTION

The present invention relates to a technique for feedback controlling an air-fuel ratio of a combustion mixture in an internal combustion engine to a target air-fuel ratio.

DESCRIPTION OF THE RELATED ART

It is common in an internal combustion engine mounted on a vehicle to feedback control an air-fuel ratio of a combustion mixture to a target value, in order to purify the exhaust gas or improve the fuel economy.

Therefore, a fuel supply amount is feedback controlled utilizing a PID control (proportional-plus-integral-plus-derivative control), while detecting sequentially an air-fuel ratio by an air-fuel ratio sensor disposed in an exhaust: passage and the like, so as to converge the detected air-fuel ratio to a target air-fuel ratio.

On the other hand, a sliding mode control is known for its high robust performance suppressing an influence by disturbances, which is often used to control robots. There has been a proposal to utilize the sliding mode control to the air-fuel ratio feedback control (refer to Japanese Unexamined Patent Publication No. 8-232713).

By the sliding mode control, the convergence performance is improved by swiftly guiding the system status onto a switching line (S=0). However, setting of the nonlinear term simply to a large value causes overshoot of the system status, which oscillates with great width centering on the switch line, and results in the fluctuation of the air-fuel ratio. In the above-mentioned sliding mode control, a deviation between a target air-fuel ratio and an actual air-fuel ratio is set as the switching function, and the nonlinear term is computed by integrating a feedback gain, the positive/negative of which is switched according to the positive/negative of the switching function. However, when the target air-fuel ratio is changed greatly, there is delay in the system status reaching the switching line, and a response characteristic is deteriorated. If the feedback gain is increased in order to suppress this delay, the nonlinear term to be integrated by the air-fuel ratio sensor during detection delay is increased, causing a large overshoot to increase a fluctuation of air-fuel ratio.

Even further, the fluctuation of air-fuel ratio is also caused in a system equipped with a fuel vapor processing device, which adsorbs and collects the fuel vapor generated in a fuel tank of a vehicle by a canister, and purges the fuel adsorbed and collected in the canister and supplies the fuel to an intake system (such as an intake collector) of the engine for combustion, under a predetermined operating condition.

Namely, a feedback control is performed so as to maintain the target air-fuel ratio by reducing a fuel injection amount to be injected by a fuel injection valve by an amount supplied to the engine by purging when fuel is purged from the canister. As a result, when the purging is cut off to suddenly stop the fuel supply from the canister to the engine, an air-fuel ratio fluctuation will be caused to shift the air-fuel ratio greatly to a lean side during a response delay of the feedback control.

SUMMARY OF THE INVENTION

The present invention aims at solving the problems of the prior art. The object of the present invention is to suppress a fluctuation of an air-fuel ratio, when an operating condition is switched so that the air-fuel ratio is changed during an air-fuel ratio feedback control.

Especially, the object of the present invention is to suppress the fluctuation of the air-fuel ratio, when a target air-fuel ratio is switched, or when the purging of fuel vapor is cut off in a case that an engine is equipped with a device for processing fuel vapor by purging the fuel vapor to an intake system of the engine.

Moreover, the object of the invention is to suppress the fluctuation of the air-fuel ratio easily by setting an appropriate nonlinear term when the air-fuel ratio is feedback controlled using a sliding mode control.

In order to achieve the above objects, the present invention is constituted to include:

- computing an air-fuel ratio feedback control amount including a linear term and a nonlinear term by a sliding mode control.
- feedback controlling an air-fuel ratio of a combustion mixture to a target air-fuel ratio, using the computed air-fuel ratio feedback control amount.
- initializing the nonlinear term to a predetermined value to correspond to a post-switched operating condition when an operating condition where the air-fuel ratio is changed is switched.

According to this constitution, when the operating condition is switched so that the air-fuel ratio changes, the nonlinear term is initialized to a predetermined value set to correspond to the post-switched operating condition. Accordingly, the air-fuel ratio is swiftly converged to the air-fuel ratio corresponding to the switched operating condition, thereby enabling to suppress the fluctuation of the air-fuel ratio.

The time of switching of the operating condition is, for example, the time of when the target air-fuel ratio is switched, and therefore, the air-fuel ratio may be converged swiftly to the target air-fuel ratio.

Alternatively, in an engine equipped with a fuel vapor processing device for adsorbing and collecting fuel vapor generated in a fuel tank to a canister while supplying purged fuel from the canister to an intake system of the engine, the time of switching of the operating condition may be the time of when the purging is cut off. According to this constitution, the nonlinear term can be switched in stepwise to a predetermined value corresponding to the time of when the purging is cut off, thereby enabling to suppress the air-fuel ratio fluctuation during the purging cut off.

Further, the predetermined value may be stored in advance in a memory for each target air-fuel ratio. According to this constitution, the nonlinear term can be initialized to a predetermined value corresponding to the post-switched operating condition while saving the memory capacity.

Alternatively, the predetermined value may be computed in accordance with the target air-fuel ratio. Thereby, the air-fuel ratio is restrained to the vicinity of the target air-fuel ratio, to swiftly converge the air-fuel ratio to the target air-fuel ratio.

Even further, the linear term and the nonlinear term may be computed by a sliding mode control with a switching function thereof being a deviation between the air-fuel ratio and the target air-fuel ratio of the combustion mixture.

The setting of this switching function S is performed by a so-called direct switching function method of the sliding mode control, which defines, as the switching function S, a function realizing a state to be achieved by the switching plane (S=0) (in this case, the air-fuel ratio becoming the target air-fuel ratio). According to this method, the feedback control by the sliding mode control can be performed easily and with high accuracy.

Moreover, there is no need of a complex operation for modeling the engine when setting the switching function, and therefore, the present invention can be used generally to any engine without being influenced by the types of the vehicle or the engine.

Further, in the sliding mode control with the deviation mentioned above as the switching function, the nonlinear term may be computed by integrating a feedback gain, the positive/negative of which is switched in accordance with the positive/negative of the switching function.

According to this constitution, the positive/negative of the switching function is reversed every time the state of air-fuel ratio crosses the switching line, which causes the positive/negative of the feedback gain to be reversed and, by the nonlinear term obtained by integrating this feedback gain, the air-fuel ratio state can converged to the target air-fuel ratio while being restrained on the switching line.

Therefore, the air-fuel ratio can be converged to the target air-fuel ratio swiftly while being restrained in the vicinity of the target air-fuel ratio.

Moreover, an absolute value of the feedback gain may be set variably in accordance with the engine operating condition, such as, an engine load for example an intake air quantity or the rotation speed.

According to this constitution, the feedback gain whose absolute value is variably set in accordance with the engine operating condition can be used to compute the nonlinear term of the air-fuel ratio feedback control amount.

This enables to prevent the value of the nonlinear term from being integrated excessively during the detection delay time of the air-fuel ratio, and to perform a stable air-fuel ratio feedback control by reducing appropriately the deviation of the actual air-fuel ratio from the target air-fuel ratio, while maintaining the response characteristic.

Moreover, the linear term may be computed as a value proportional to a ratio of the deviation to the air-fuel ratio of the combustion mixture.

According to this constitution, the more the air-fuel ratio state deviates from the switching line, the greater the linear term is set in proportion to this deviation.

Thereby, the air-fuel ratio can be converged on the switching line toward the target air-fuel ratio swiftly, while suppressing overshoot.

The other objects and features of this invention will become understood from the following description with the accompanied drawings.

DETAILED DESCRIPTION OF PREFERRED EMBODIMENTS

Embodiments of the present invention will now be explained with reference to the drawings.

Figure 1:
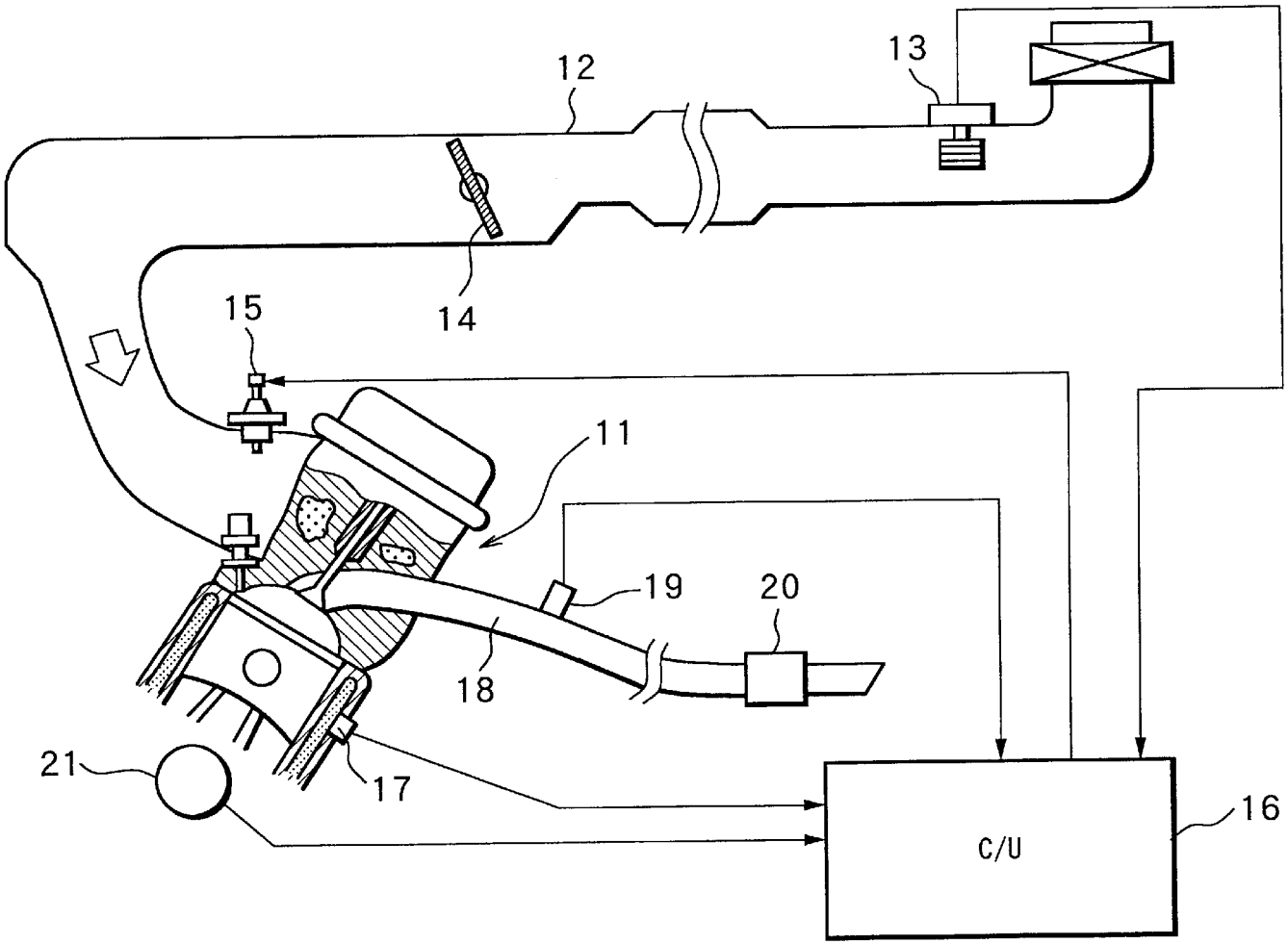
FIG. 1 shows the system structure of an internal combustion engine according to a first embodiment of the present invention.

In FIG. 1 showing a system structure of an internal combustion engine according to a first embodiment, an airflow meter 13 for detecting an intake airflow quantity Qa and a throttle valve 14 for controlling the intake airflow quantity Qa in linkage with an accelerator pedal are disposed in an intake passage 12 of an engine 11. Moreover, an electromagnetic fuel injection valve 15 is disposed in an intake manifold portion on the downstream side of the engine for each cylinder.

The fuel injection valve 15 is driven to open by an injection pulse signal from a control unit 16 incorporating a microcomputer therein, and injectingly supplies fuel sent under pressure from a fuel pump not shown and controlled to a predetermined pressure by a pressure regulator. Moreover, a water temperature sensor 17 for detecting the cooling water temperature Tw within a cooling jacket of the engine 11, and a wide-range type air-fuel ratio sensor 19 for detecting linearly an air-fuel ratio of the combustion mixture according to an oxygen concentration in the exhaust of an exhaust passage 18 are provided to the engine. Moreover, a three-way catalytic converter 20 is provided to the engine, for performing the oxidization of CO and HC, and the reduction of $NO_x$ included in the exhaust on the downstream side to purify the exhaust.

The structure of the wide-range type air-fuel ratio sensor 19 will now be explained with reference to FIG. 2.

On a substrate 31 made of a solid electrolyte member such as zirconia ($ZrO_2$) and the like is formed a positive electrode 32 for measuring an oxygen concentration. Moreover, the substrate 31 is further formed with an atmosphere introduction hole 33 through which atmosphere is introduced. A negative electrode 34 is mounted onto the atmosphere introduction hole 33 opposed to the positive electrode 32.

In this way, an oxygen concentration detecting unit 35 is formed by the substrate 31, the positive electrode 32 and the negative electrode 34.

Moreover, the wide-range type air-fuel ratio sensor 19 has an oxygen pump unit 39 which is formed by providing a pair of pump electrodes 37, 38 made of platinum on both sides of a solid electrolyte member 36 made of zirconia and the like.

The oxygen pump unit 39 is laid over the oxygen concentration detecting unit 35 via a frame-shaped spacer 40 made of alumina, so that a hollow chamber 41 is formed between the oxygen concentration detecting unit 35 and the oxygen pump unit 39, and an introduction hole 42 for introducing the exhaust of the engine into the hollow chamber 41 is formed on the solid electrolyte member 36 of the oxygen pump unit 39.

The periphery of the spacer 40 is filled with an adhesive 43 made of glass, thereby securing the sealing performance of the hollow chamber 41, and adhesively fixing the substrate 31, the spacer 40 and the solid electrolyte 36 together. Since the spacer 40 and the substrate 31 are bonded together through simultaneous baking, the sealing performance of the hollow chamber 41 is secured by bonding the spacer 40 and the solid electrolyte member 36. Even further, a heater 44 used for warm-up is incorporated in the oxygen concentration detecting unit 39.

An oxygen concentration of the exhaust introduced to the hollow chamber 41 through the introduction hole 42 is detected based on a voltage of the positive electrode 32. Specifically, an oxygen ion current flows through the substrate 31 in accordance with a difference in concentration between the oxygen in the atmosphere within the atmosphere introduction hole 33 and the oxygen in the exhaust within the hollow chamber 41, and accompanied by this current flow, a voltage corresponding to the oxygen concentration in the exhaust is generated in the positive electrode 32.

Based on this detection result, a value of the current flowing to the oxygen pump unit 39 is variably controlled so as to maintain the atmosphere within the hollow chamber 41 to be constant (for example, the theoretical air-fuel ratio), and the oxygen concentration in the exhaust is detected based on the current value at that time.

Specifically, the voltage of the positive electrode 32 is amplification processed by a control circuit 45 and then applied between the electrodes 37 and 38 via a voltage detecting resistor 46, thereby maintaining the oxygen concentration within the hollow chamber 41 to be constant.

For example, when detecting the air-fuel ratio in a lean region where the oxygen concentration in the exhaust is high, the outer pump electrode 37 is set as anode and the pump electrode 38 in the hollow chamber 41 is set as cathode, to apply a voltage. Then, the oxygen amount (oxygen ion $O^{2-}$) proportional to the current is pumped out from the hollow chamber 41 to the outside. When the applied voltage becomes a predetermined value or above, the flowing current reaches a limit value, and by measuring the limit current value by the control circuit 45, the oxygen concentration in the exhaust, in other words, the air-fuel ratio, is detected.

On the other hand, if oxygen is pumped into the hollow chamber 41 by setting the pump electrode 37 as cathode and the pump electrode 38 as anode, the air-fuel ratio in a rich region where the oxygen concentration in the exhaust is low can be detected.

The limit current is detected by an output voltage of a differential amplifier 47 that detects a voltage between terminals of the voltage detecting resist 46.

Returning to FIG. 1, a crank angle sensor 21 is incorporated in a distributor not shown, and the engine rotation speed Ne is detected either by counting a crank unit angle signal output from the crank angle sensor 21 in synchronism with the engine rotation or by measuring the cycle of a crank reference angle signal.

The control unit 16 computes and controls a fuel injection quantity from the fuel injection valve 15 and the ignition timing. Here, in an air-fuel ratio feedback control region, an air-fuel ratio feedback control is performed by a sliding mode control according to the present invention, so that the air-fuel ratio (actual air-fuel ratio) detected by the air-fuel ratio sensor 19 coincides with a target air-fuel ratio corresponding to the operating condition.

Figure 3:
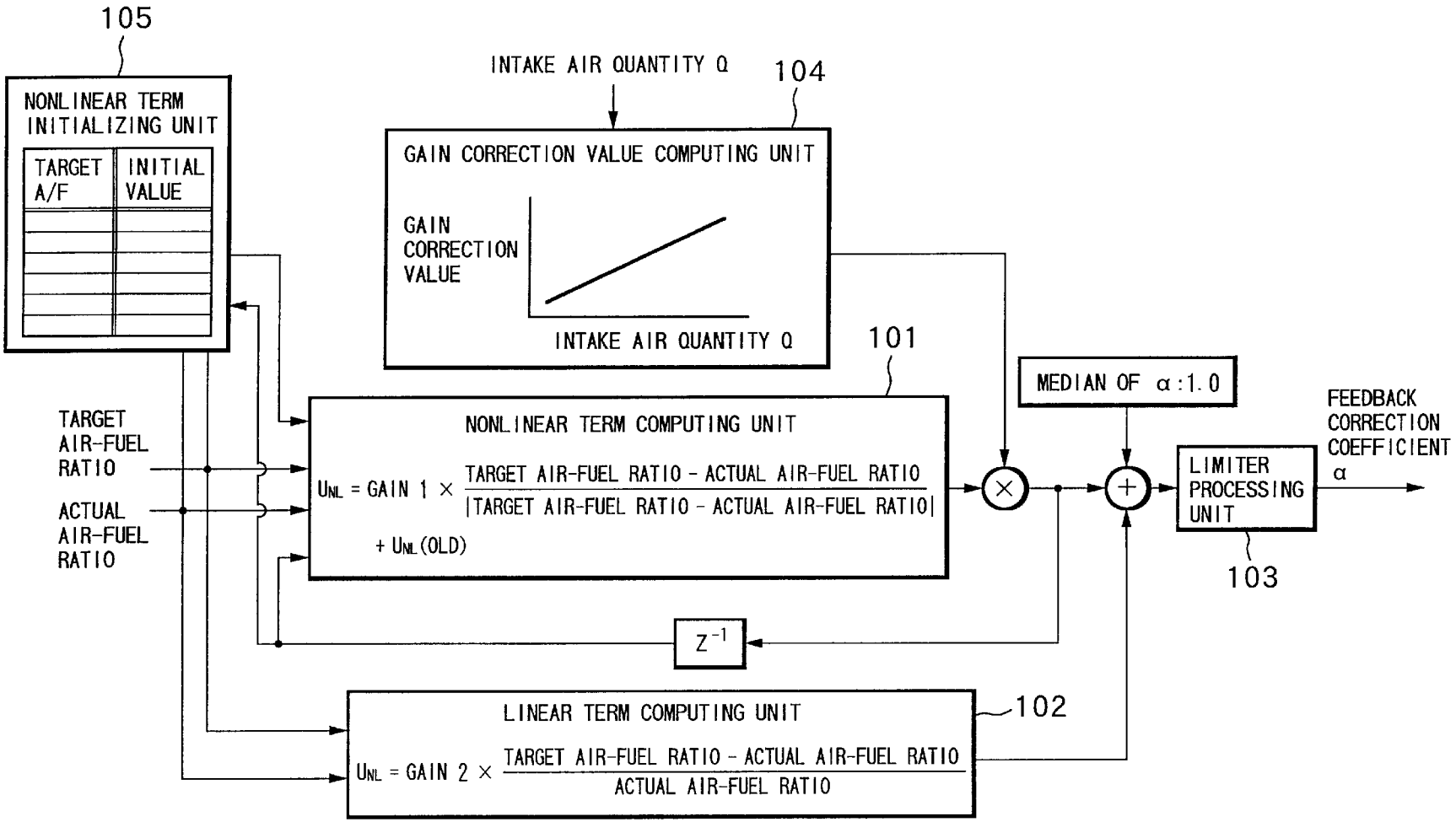
FIG. 3 is a control block diagram showing an air-fuel ratio feedback control according to the first embodiment.

FIG. 3 is a block diagram showing the air-fuel ratio feedback control by the above-mentioned sliding mode control.

At a nonlinear term computing unit 101, a nonlinear term $U_{NL}$ of the feedback control amount is computed according to a following formula;

$$U_{NL}=(\text{gain } 1)\times(\text{target air-fuel ratio}-\text{actual air-fuel ratio})/(|\text{target air-fuel ratio}-\text{actual air-fuel ratio}|)+U_{NL(OLD)}$$

wherein gain 1 is a negative fixed value determined in advance, target air-fuel ratio is the target value of the air-fuel ratio set in accordance with the operating condition at that time, actual air-fuel ratio is the one of when detected by the air-fuel ratio sensor 19, and $U_{NL(OLD)}$ is the previous value of the nonlinear term $U_{NL}$.

In other words, in the sliding mode control, by setting the switching function S as switching function S=target air-fuel ratio−actual air-fuel ratio based on a direct switching function method, the switching line (S=0) becomes a desired state, that is, actual air-fuel ratio=target air-fuel ratio, so that the increase/decrease direction (positive/negative) of a feedback gain is switched whenever the air-fuel ratio crosses the switching line. Then, the nonlinear term $U_{NL}$ is computed as a value obtained by integrating the feedback gain, the increase/decrease direction (positive/negative) of which is switched at the switching line (S=0).

Moreover, a linear term $U_L$ of the feedback control amount is computed at a linear term computing unit 102 based on the following formula;

$$U_L=(\text{gain } 2)\times(\text{target air-fuel ratio}-\text{actual air-fuel ratio})/\text{actual air-fuel ratio}$$

wherein gain 2 is a negative fixed value.

A value obtained by adding the linear term $U_L$ and the nonlinear term $U_{NL}$ of the feedback control amount is further added to the median of an air-fuel ratio feedback correction coefficient $\alpha$ (the value corresponding to no-feedback control: 1.0). Then, the value is subjected to a limiter process at a limiter process unit 103 so as to be equal to or smaller than the upper limit value and equal to or greater than the lower limit value, before being output.

Thereafter, similar to the usual air-fuel ratio control, a value obtained by correcting a basic fuel injection quantity $T_p$ computed based for example on an intake air quantity and the engine rotation speed by various correction coefficients COEF, is multiplied by the feedback correction coefficient $\alpha$ computed as mentioned above. Further, a battery voltage correction portion $T_s$ is added to the multiplied value, thereby computing a fuel injection quantity (fuel injection pulse width) Ti (Ti=TpxCOEFx$\alpha$+Ts), and outputting a drive signal (pulse) to the fuel injection valve 15 for injecting fuel.

Here, the basic fuel injection quantity $T_p$ is set as a value equivalent to the theoretical air-fuel ratio, and the feedback correction coefficient a is set as the following formula.

$$\alpha=1.0(\text{said median})+\text{linear term } U_L+\text{nonlinear term } U_{NL}$$

Further, corresponding to the detection delay time of the air-fuel ratio that changes depending on the intake air quantity, a gain correction value computing unit 104 is provided for correcting gain 1 of the nonlinear term $U_{NL}$. An absolute value of gain 1 is corrected to a smaller value as the less the intake air quantity is, which causes the delay time to be increased.

Instead of correcting gain 1 in accordance with the intake air quantity, the absolute value of gain 1 may be corrected in accordance with the engine rotation speed, or the correction value may be determined based on the combination of engine load and engine rotation speed. In any case, the absolute value of gain 1 is corrected to a smaller value as the delay time increases.

When switching the target air-fuel ratio, a nonlinear term initializing unit 105 initializes the nonlinear term $U_{NL}$ to an initial value set corresponding to the post-switched target air-fuel ratio.

Figures 4, 5:
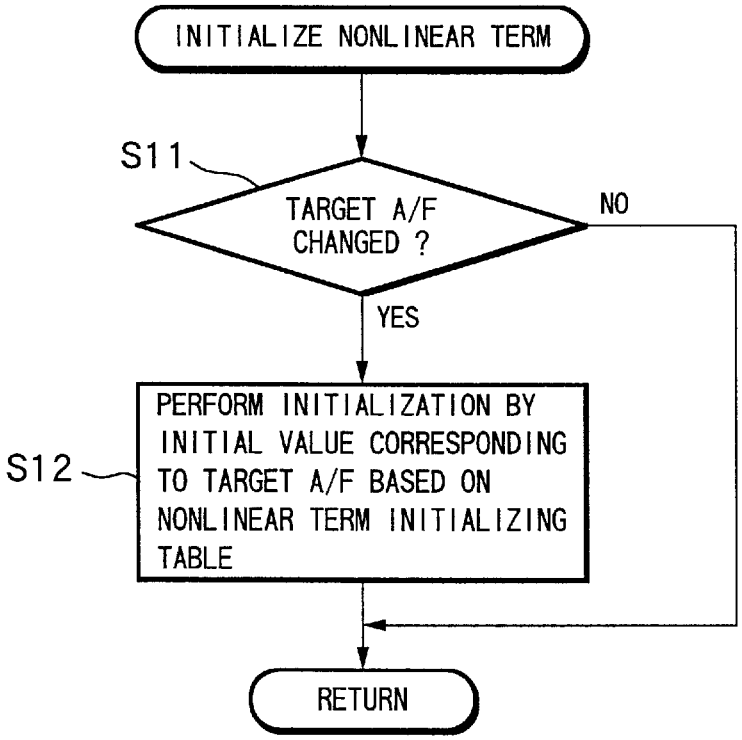
FIG. 4 is a flowchart showing an initialization control of a nonlinear term in the first embodiment.
FIG. 5 is a table showing an initial value of the nonlinear term for each target air-fuel ratio in the first embodiment.

The initializing process performed by the nonlinear term initializing unit 105 is explained according to a flowchart of FIG. 4.

According to the flowchart of FIG. 4, in step S11, it is judged whether or not the target air-fuel ratio (target A/F) has changed or not, and when the target air-fuel ratio has changed, the procedure is advanced to step S12.

In step S12, an initial value table is referred to in which an initial value is set for each target air-fuel ratio, to read the initial value stored in the table corresponding to the post-switched target air-fuel ratio. Specifically, the initial value of the nonlinear term is computed based on the following formula, and a table as shown in FIG. 5 is obtained for each target air-fuel ratio.

initial value=(14.7/target air-fuel ratio)−1 provided that the theoretical air-fuel ratio=14.7

After initializing the nonlinear term $U_{NL}$ in accordance with the change in the target air-fuel ratio, the nonlinear term $U_{NL}$ is updated by integrating the feedback gain within a predetermined time period while switching the negative/positive of the feedback gain whenever the air-fuel ratio state crosses the switching line.

In this way, since the system status can be on the switching line (S=0) swiftly in response to the change in the target air-fuel ratio while preventing overshoot, the convergence performance of the air-fuel ratio to the target air-fuel ratio is improved, and fluctuation of air-fuel ratio is suppressed.

Figure 6:
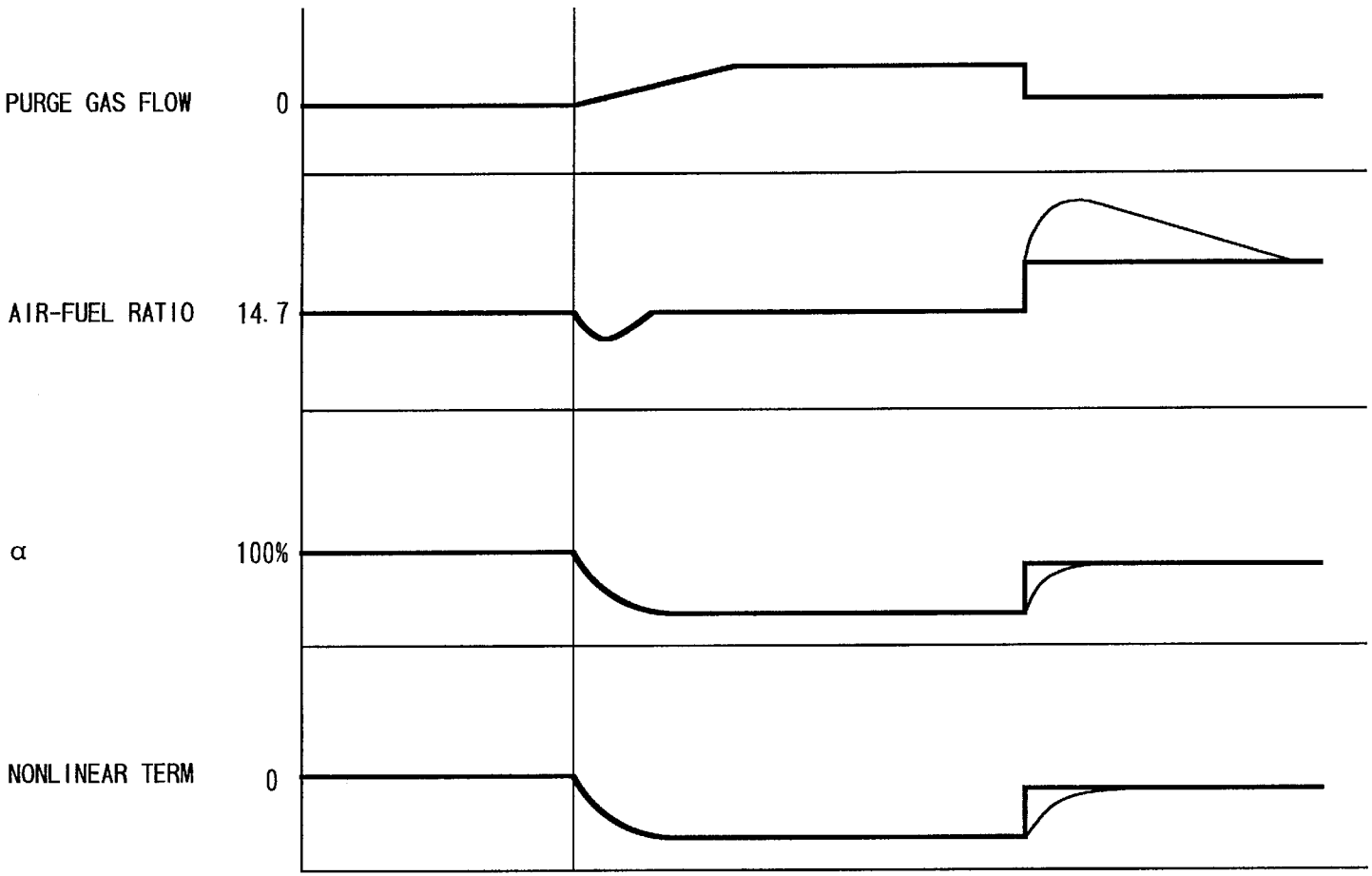
FIG. 6 is a time chart showing a change in air-fuel ratio during a purge control of fuel vapor in the first embodiment.

FIG. 6 is a time chart showing the state where the fuel vapor stored temporarily in a canister is purged to the intake system in accordance with the operating condition, and the purge is cut off depending on the change in the operating condition in the air-fuel ratio control according to the present embodiment, showing.

When purging is started, the nonlinear term is gradually reduced so as to suppress the air-fuel ratio from being rich by the purged fuel vapor. When the operating condition changes to change the target air-fuel ratio (for example, when the air-fuel ratio becomes lean) and a command to cut off the purge is output, the nonlinear term is switched to an initial value corresponding to the post-switched target air-fuel ratio (refer to the thick line of FIG. 6).

According to the conventional control, the feedback correction coefficient a is not initialized even when the target air-fuel ratio is changed, and integration is performed to gradually converge the air-fuel ratio to the post-switched target air-fuel ratio. Accordingly, there is a large deviation between the air-fuel ratio and the target air-fuel ratio during this time (refer to the thin line of FIG. 6). However, according to the present embodiment, the nonlinear term is swiftly switched to the initial value corresponding to the post-switched air-fuel ratio, effectively preventing the deviation of air-fuel ratio.

Figure 7:
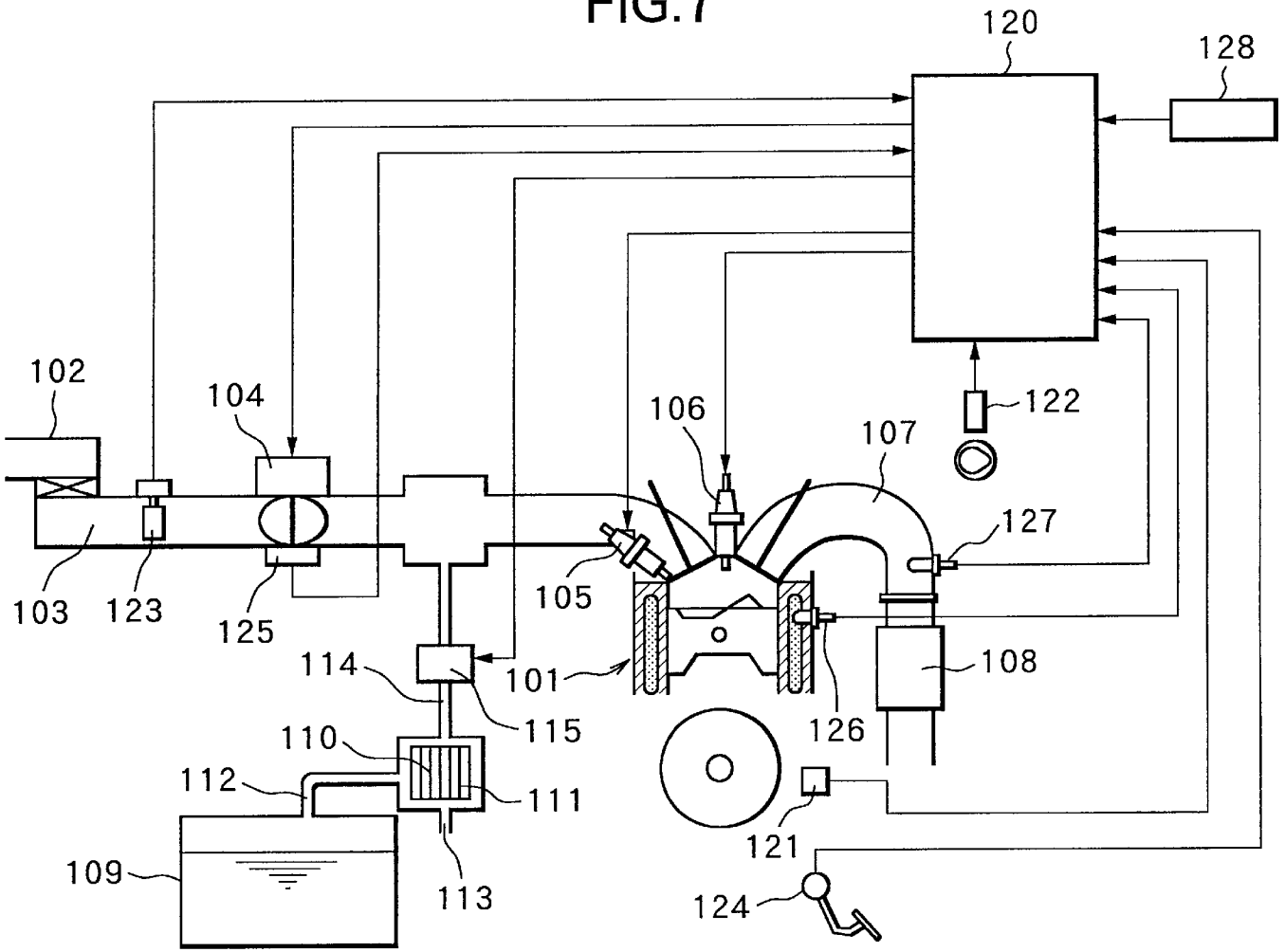
FIG. 7 shows a system structure of an internal combustion engine according to a second embodiment of the present invention.

Next, a second embodiment according to the present invention will be explained. The second embodiment is applied to an air-fuel ratio feedback control during purge cut, irrespective of the switching of the target air-fuel ratio (as mentioned, even when the target air-fuel ratio is not changed, fluctuation of the air-fuel ratio occurs during purge cut). FIG. 7 shows the system structure of an internal combustion engine according to the second embodiment of the present invention.

In FIG. 7, air is sucked into a combustion chamber of each cylinder in an internal combustion engine 101 mounted on a vehicle through an air cleaner 102, an intake passage 103 and an electronically controlled throttle valve 104 that is driven to open or close by a motor. Furthermore, an electromagnetic fuel injection valve 105 is disposed to the combustion chamber of each cylinder for directly injecting fuel (gasoline) into the combustion chamber. The fuel injected through the fuel injection valve 105 and the air sucked into the chamber as explained above constitutes an air-fuel mixture in the combustion chamber.

Power is supplied to a solenoid by an injection pulse signal output from a control unit 120, to open the fuel injection valve 105 through which fuel adjusted to a predetermined pressure is injected. Then, in the case of a suction stroke injection, the injected fuel is diffused within the combustion chamber to form a homogeneous air-fuel mixture. In the case of a compression stroke injection, the fuel forms a stratified air-fuel mixture concentrated around an ignition plug 106. The air-fuel mixture formed within the combustion chamber is ignited and combusted by the ignition plug 106.

However, the internal combustion engine 101 is not limited to the direct injection gasoline engine as mentioned above, and it can be an engine where the fuel is injected to an intake port.

The exhaust from the engine 101 is discharged from an exhaust passage 107. A catalytic converter 108 for purifying the exhaust is disposed in the exhaust passage 107.

The engine is further equipped with a fuel vapor processing device for performing combustion processing of the fuel vapor generated in a fuel tank 109.

A canister 110 is a sealed container filled with an adsorbent 111 such as activated carbon and the like, to which is connected a fuel vapor introduction pipe 112 extending from the fuel tank 109. Therefore, the fuel vapor generated in the fuel tank 109 is introduced through the fuel vapor introduction pipe 112 to the canister 110, to be adsorbed and collected therein.

A new air introduction opening 113 is formed to the canister 110, and a purge pipe 114 is extended out from the canister. The purge pipe 114 is equipped with a purge control valve 115, which is controlled to open or close by a control signal from the control unit 120.

In the above structure, when the purge control valve 115 is controlled to open, as a result that a negative intake pressure of the engine 101 acts on the canister 110, air introduced through the new air introduction opening 113 purges the fuel vapor adsorbed to the adsorbent 111 of the canister 110, and purge air passes through the purge pipe 114 to be sucked to the downstream of the throttle valve 104 in the intake passage 103, and thereafter, subjected to the combustion treatment in the combustion chamber of the engine 101.

The control unit 120 is equipped with a microcomputer comprising a CPU, a ROM, a RAM, an A/D converter, an input/output interface and the like, and receives input signals from various sensors, and performs computing processes based on the input signals, thereby controlling the operations of the fuel injection valve 105, the ignition plug 106, the purge control valve 115 and the like.

Various sensors include a crank angle sensor 121 for detecting crank angles of the engine 101 and a cam sensor 122 for taking out cylinder discrimination signals from a camshaft. The rotation speed of the engine is computed based on the signals from the crank angle sensor 121.

In addition, various sensors include an airflow meter 123 for detecting an intake airflow quantity Qa at the upstream of the throttle valve 104 in the intake passage 103, an accelerator sensor 124 for detecting a pedal depression quantity of an accelerator pedal (accelerator opening) APS, a throttle sensor 125 for detecting an opening TVO of the throttle valve 104, a water temperature sensor 126 for detecting the cooling water temperature Tw of the engine 101, a wide-range type air-fuel ratio sensor 127 for detecting linearly an air-fuel ratio of a combustion mixture based on an oxygen concentration of the exhaust, a vehicle speed sensor 128 for detecting the vehicle speed VSP, and so on.

Figure 2:
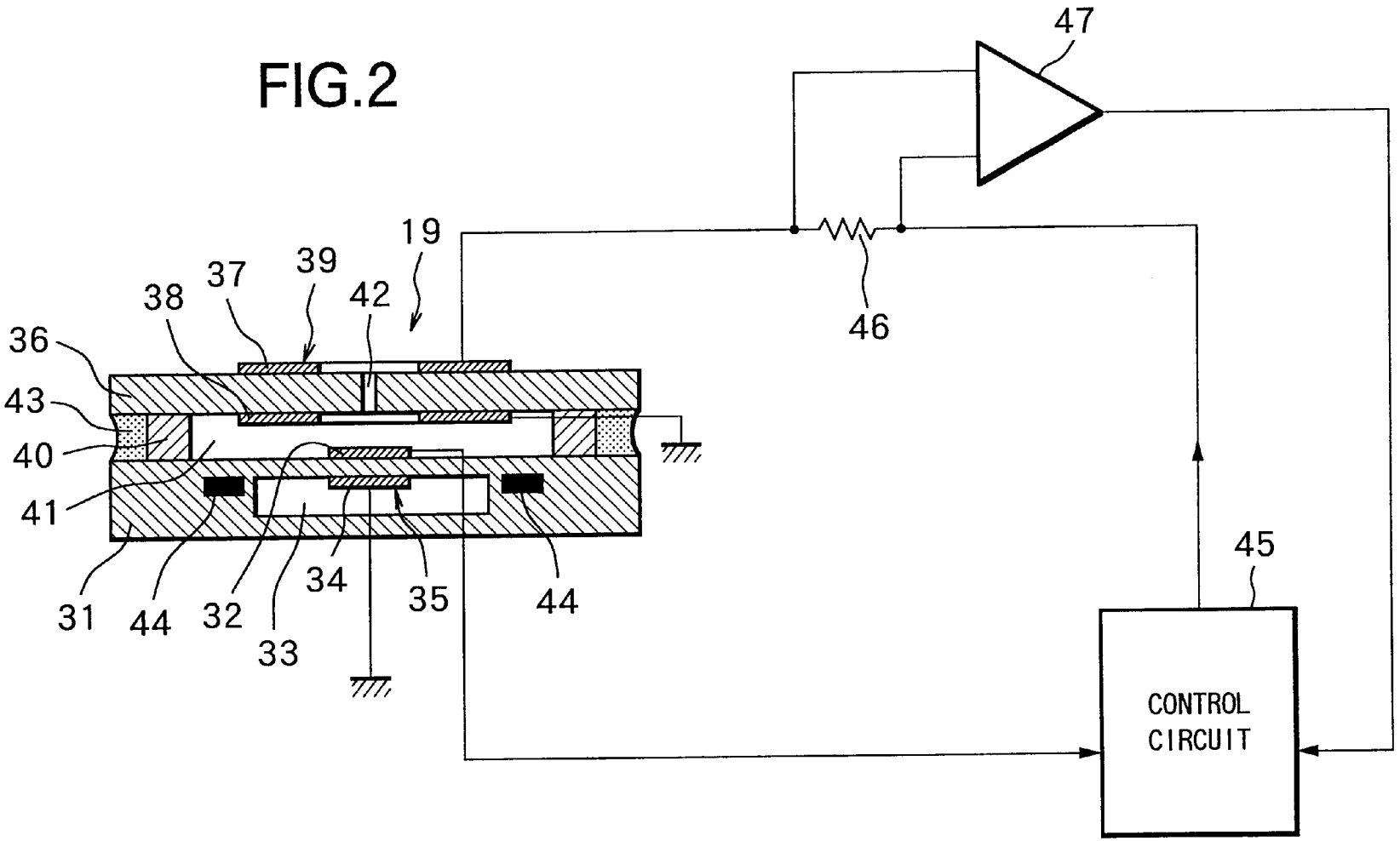
FIG. 2 shows an air-fuel ratio sensor and its peripheral circuit according to the first embodiment.

The structure of the wide-range type air-fuel ratio sensor 127 is similar to that explained in the first embodiment shown in FIG. 2.

When a predetermined air-fuel ratio feedback control condition is fulfilled, the control unit 120 performs the air-fuel ratio feedback control by the sliding mode control according to the present invention, so that an air-fuel ratio detected by the air-fuel ratio sensor 127 (actual air-fuel ratio) coincides with a target air-fuel ratio in accordance with the operating condition.

Figure 8:
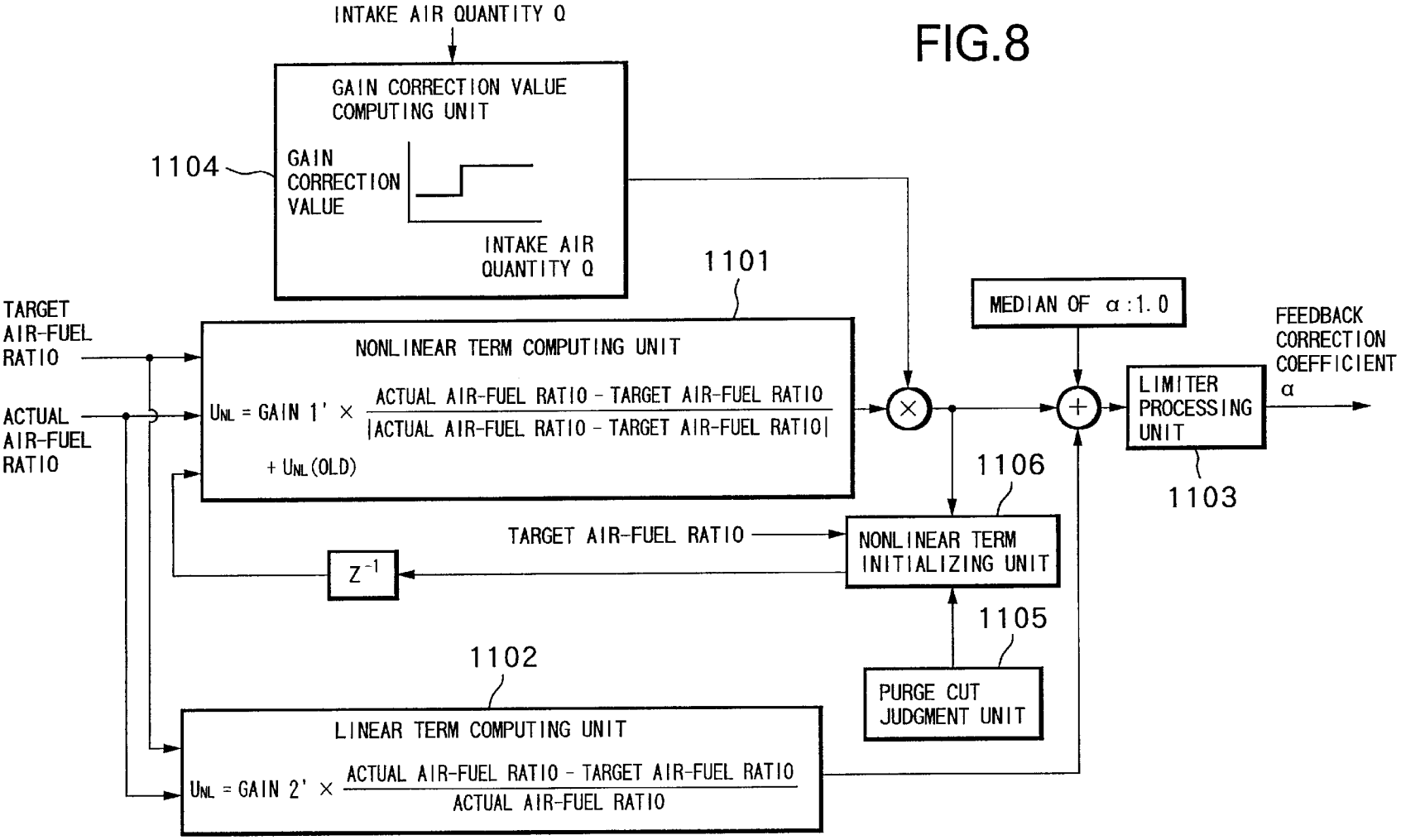
FIG. 8 is a control block diagram showing an air-fuel ratio feedback control according to the second embodiment.

FIG. 8 is a block diagram showing the air-fuel ratio feedback control by the sliding mode control.

A nonlinear term computing unit 1101, a linear term computing unit 1102, a limiter processing unit 1103, and a gain correction value computing unit 1104 are the same as those shown in FIG. 3 of the first embodiment. In the nonlinear term computing unit 1101 and the linear term computing unit 1102, gain 1 and gain 2 are set to positive fixed values, respectively, and the numerator (=actual air-fuel ratio−target air-fuel ratio) is set to have a reversed sign (positive/negative) to the numerator (=target air-fuel ratio−actual air-fuel ratio) of the nonlinear term computing unit 101 and the linear term computing unit 102 of FIG. 3, so there is no substantial change.

In the gain correction value computing unit 1104, a gain correction value is switched stepwise corresponding to the intake air quantity. However, similar to the first embodiment, the gain correction value may have a characteristic to be linearly switched. Or, the gain correction value may be set corresponding to the engine rotation speed.

According to the present embodiment, a nonlinear term initializing unit 1106 is further provided for initializing the nonlinear term $U_{NL}$ to a predetermined value in accordance with a judgment result by a purge cut judgment unit 1105.

The purge cut judgment unit 1105 is for judging a timing to control the purge control valve 115 to open to cut off purge from a state where the purge control valve 115 is controlled to open to purge from the canister 110. When the purge control valve 115 is to be switched from an opened state to a closed state, a purge cut signal is output to the nonlinear term initializing unit 1106.

The nonlinear term initializing unit 1106 that has received the purge cut signal, performs initialization to switch the nonlinear term $U_{NL}$ (previous value $U_{NL(OLD)}$) to a predetermined value.

A value corresponding to the target air-fuel ratio at the time of purge cut is set as the predetermined value. Specifically, a table storing in advance the predetermined value for each target air-fuel ratio is referred to obtain the value corresponding to the target air-fuel ratio at the time of purge cut, or the predetermined value is obtained by the computation based on the target air-fuel ratio at the time of purge cut.

During purge cut, the purge fuel from the canister 110 that has been supplied to the engine 101 up to that time is cut off. Thereby, the air-fuel ratio is fluctuated to become lean during a response delay of the feedback control. Therefore, the nonlinear term $U_{NL}$ is changed stepwise to a basic value for realizing the target air-fuel ratio in the purge cut status, thereby suppressing fluctuation of the air-fuel ratio.

Figure 9:
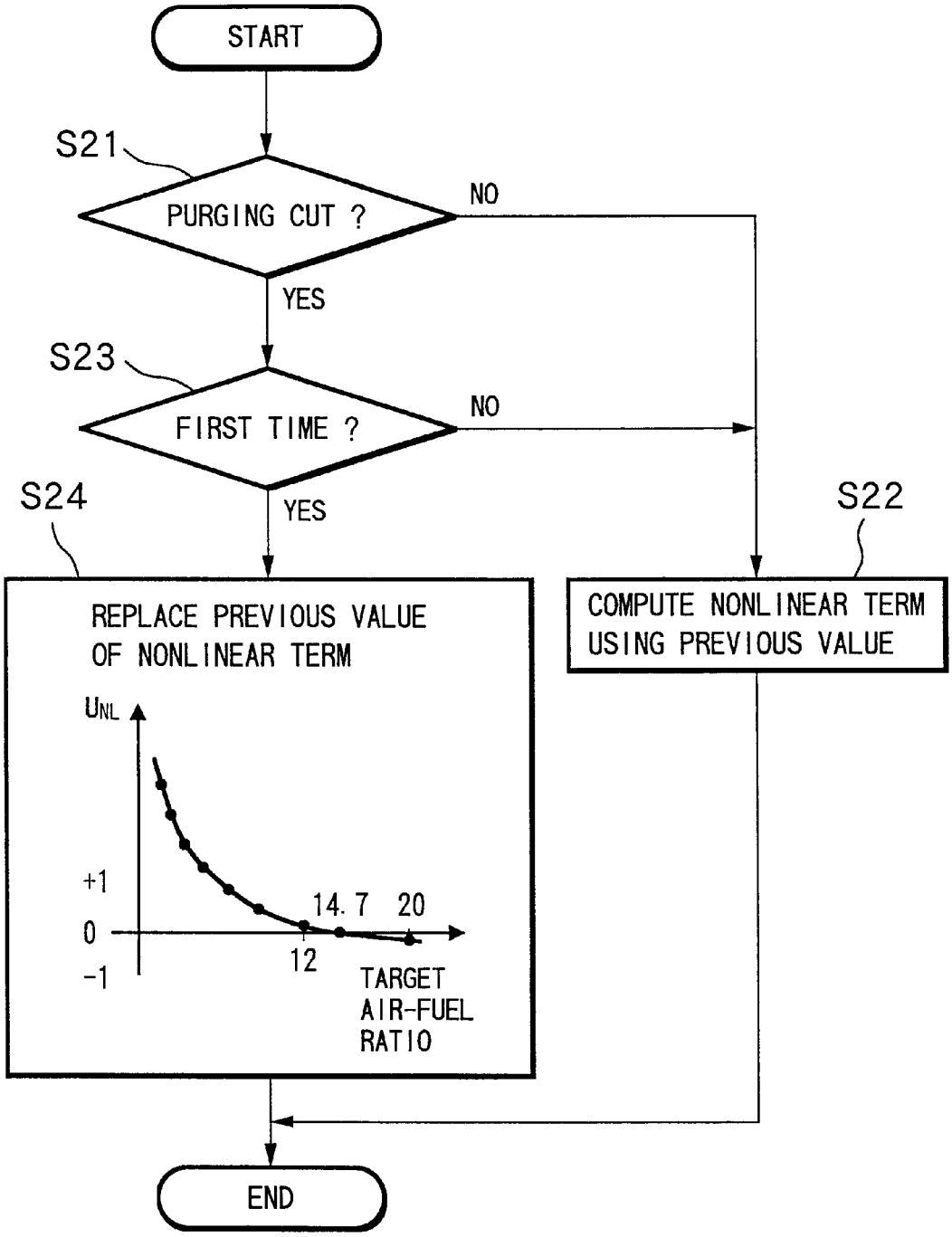
FIG. 9 is one example of a flowchart showing an initialization control of a nonlinear term at the time of purge cut in the second embodiment.

The flowchart of FIG. 9 shows an embodiment where the initialization control of the nonlinear term $U_{NL}$ (previous value $U_{NL(OLD)}$) is performed by referring to a table storing in advance the basic value of the nonlinear term $U_{NL}$ for each air-fuel ratio. In step S21, it is judged whether purging is cut off or not (when the purge control valve 15 is switched from the opened state to the closed state). When purging is not cut off, the procedure is advanced to step S22 where the nonlinear term $U_{NL}$ is computed normally using the previous value $U_{NL(OLD)}$.

On the other hand, in step S21, it is judged that purge is cut off, the procedure is advanced to step S23 where it is judged whether it is a first time after the purge cut judgment. If it is not the first time, the procedure advances to step S22, while if it is the first time, the procedure advances to step S24.

In step S24, a table storing in advance the basic value of the nonlinear term $U_{NL}$ for each target air-fuel ratio is referred to, and the basic value corresponding to the target air-fuel ratio at the time of purge cut is retrieved. Then, initialization is performed for replacing the previous value $U_{NL(OLD)}$ with the retrieved basic value. As shown in the flowchart of FIG. 9, the basic value of the nonlinear term $U_{NL}$ is set to 0 when the target air-fuel ratio equals the theoretical air-fuel ratio, set to a greater value when the target air-fuel ratio is richer than the theoretical air-fuel ratio, and set to a smaller value when the target air-fuel ratio is leaner than the theoretical air-fuel ratio.

Figure 10:
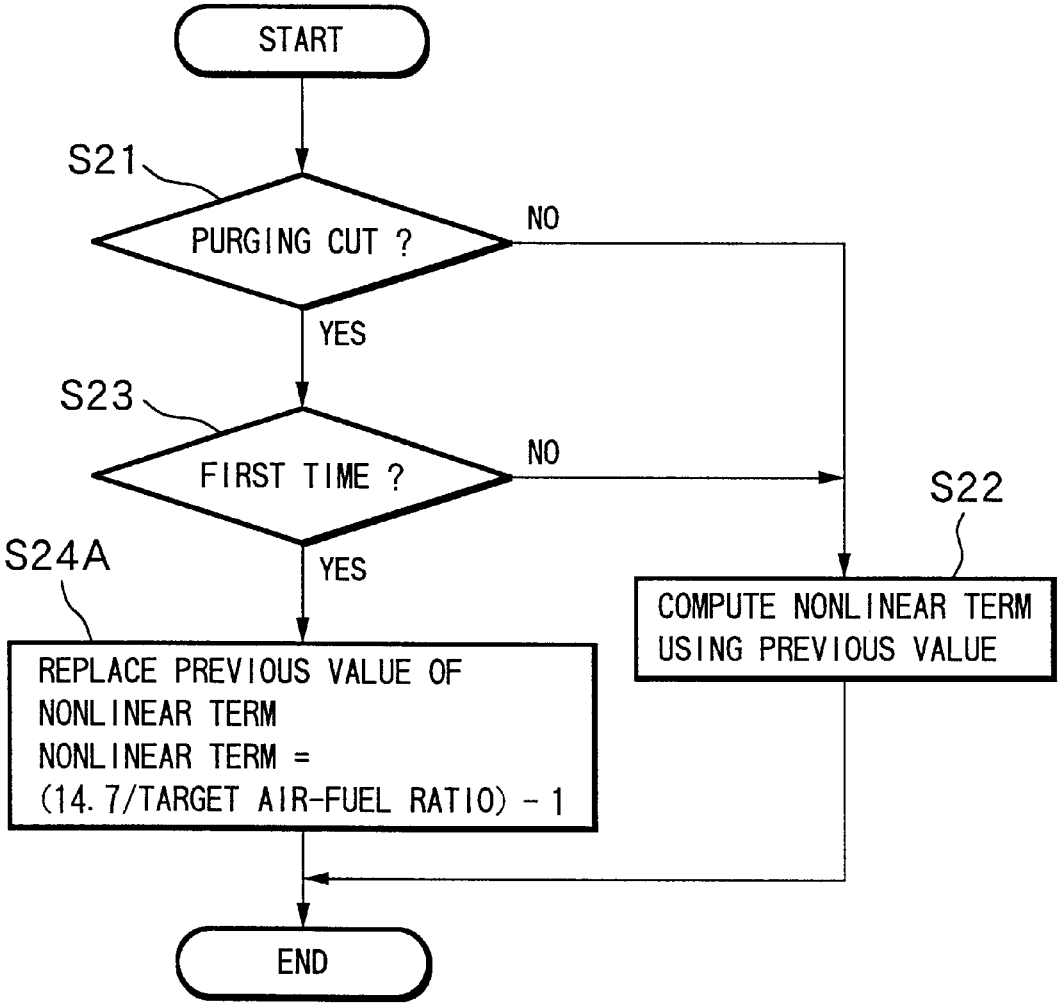
FIG. 10 is another example of a flowchart showing the initialization control of the nonlinear term at the time of purge cut in the second embodiment.

The flowchart of FIG. 10 shows an embodiment where the initialization control of the nonlinear term $U_{NL}$ (previous value $U_{NL(OLD)}$) is performed by the computation in accordance with the target air-fuel ratio, and only the procedure in step S24A differs from the procedures of the flowchart of FIG. 9.

In step S24A, the nonlinear term $U_{NL}$ is computed as:

$$\text{nonlinear term } U_{NL}=(14.7/\text{target air-fuel ratio})-1,$$

and initialization is performed by replacing the previous value $U_{NL(OLD)}$ with the nonlinear term $U_{NL}$ computed by the above formula.

The nonlinear term $U_{NL}$ retrieved from the target air-fuel ratio in step S24 of the flowchart of FIG. 9 and the nonlinear term $U_{NL}$ computed based on the same target air-fuel ratio according to the above formula will be the same value.

According to the embodiment of FIG. 9, the process speed is fast since the stored initialized value is merely read, while in the embodiment of FIG. 10, the capacity of the memory being consumed can be saved, and also the initial value can be computed smoothly corresponding to the target air-fuel ratio at the time of purge The entire contents of basic Japanese Patent Applications, No. 2000-75264 filed Mar. 17, 2000 and No. 2000-75838 filed Mar. 17, 2000, priorities of which are claimed, are herein incorporated by reference.

What is claimed:

1. An air-fuel ratio feedback control device of an internal combustion engine comprising:

a feedback control amount computing unit for computing an air-fuel ratio feedback control amount comprising a linear term and a nonlinear term by a sliding mode control;

a feedback control unit for feedback controlling an air-fuel ratio of a combustion mixture to a target air-fuel ratio, using the computed air-fuel ratio feedback control amount computed in said feedback control amount computing unit; and a nonlinear term initializing unit for initializing the nonlinear term to a predetermined value to correspond to a post-switched operating condition when an operating condition where the air-fuel ratio is changed is switched.

2. The air-fuel ratio feedback control device of an internal combustion engine according to claim 1, wherein said time of switching of the operating condition is the time of when the target air-fuel ratio is switched, and said predetermined value is a value corresponding to the post-switched target air-fuel ratio.

3. The air-fuel ratio feedback control device of an internal combustion engine according to claim 1, further comprising a fuel vapor processing device for adsorbing and collecting fuel vapor generated in a fuel tank to a canister while supplying purged fuel from the canister to an intake system of the engine, wherein said time of switching of the operating condition is the time of when said purging is cut off.

4. The air-fuel ratio feedback control device of an internal combustion engine according to claim 1, wherein said predetermined value is a value stored in advance in a memory for each target air-fuel ratio.

5. The air-fuel ratio feedback control device of an internal combustion engine according to claim 1, wherein said predetermined value is computed in accordance with said target air-fuel ratio.

6. The air-fuel ratio feedback control device of an internal combustion engine according to claim 1, wherein said feedback control amount computing unit computes said linear term and said nonlinear term by a sliding mode control with a switching function thereof being a deviation between the air-fuel ratio of the combustion mixture and the target air-fuel ratio.

7. The air-fuel ratio feedback control device of an internal combustion engine according to claim 6, wherein said nonlinear term is computed by integrating a feedback gain, the positive and negative of which is switched in accordance with the positive/negative of said switching function.

8. The air-fuel ratio feedback control device of an internal combustion engine according to claim 7, wherein an absolute value of said feedback gain is variably set in accordance with the operating condition of said engine.

9. The air-fuel ratio feedback control device of an internal combustion engine according to claim 8, wherein said absolute value of said feedback gain is variably set in accordance with an intake air quantity.

10. The air-fuel ratio feedback control device of an internal combustion engine according to claim 6, wherein said linear term is computed as a value proportional to a ratio of said deviation to the air-fuel ratio of said combustion mixture.

11. An air-fuel ratio feedback control method of an internal combustion engine, comprising the steps of:

computing an air-fuel ratio feedback control amount comprising a linear term and a nonlinear term by a sliding mode control;

feedback controlling an air-fuel ratio of a combustion mixture to a target air-fuel ratio, using the computed air-fuel ratio feedback control amount computed in said feedback control amount computing unit; and initializing the nonlinear term to a predetermined value to correspond to a post-switched operating condition when an operating condition where the air-fuel ratio is changed is switched.

12. The air-fuel ratio feedback control method of an internal combustion engine, according to claim 11, wherein said time of switching of the operating condition is the time of when the target air-fuel ratio is switched, and said predetermined value is a value corresponding to the post-switched target air-fuel ratio.

13. The air-fuel ratio feedback control method of an internal combustion engine according to claim 11, wherein fuel vapor generated in a fuel tank is adsorbed and collected to a canister while purged fuel from the canister is supplied to an intake system of the engine, and said time of switching of the operating condition is the time of when said purging is cut off.

14. The air-fuel ratio feedback control method of an internal combustion engine according to claim 11, wherein said predetermined value is stored in advance in a memory for each target air-fuel ratio.

15. The air-fuel ratio feedback control method of an internal combustion engine according to claim 11, wherein said predetermined value is computed in accordance with said target air-fuel ratio.

16. The air-fuel ratio feedback control method of an internal combustion engine according to claim 11, wherein said linear term and said nonlinear term by a sliding mode control with a switching function thereof being a deviation between the air-fuel ratio of the combustion mixture and the target air-fuel ratio, to compute said air-fuel ratio feedback control amount.

17. The air-fuel ratio feedback control method of an internal combustion engine according to claim 16, wherein said nonlinear term is computed by integrating a feedback gain, the positive and negative of which is switched in accordance with the positive/negative of said switching function.

18. The air-fuel ratio feedback control method of an internal combustion engine according to claim 17, wherein an absolute value of said feedback gain is variably set in accordance with the operating condition of said engine.

19. The air-fuel ratio feedback control method of an internal combustion engine according to claim 18, wherein said absolute value of said feedback gain is variably set in accordance with an intake air quantity.

20. The air-fuel ratio feedback control method of an internal combustion engine according to claim 16, wherein said linear term is computed as a value proportional to a ratio of said deviation to the air-fuel ratio of said combustion mixture.

* * * * *